US009039389B2

(12) United States Patent
Banister

(10) Patent No.: US 9,039,389 B2
(45) Date of Patent: May 26, 2015

(54) PULSE ACTIVATED ACTUATOR PUMP SYSTEM

(71) Applicant: MEDIPACS, INC., Tucson, AZ (US)

(72) Inventor: Mark Banister, Tucson, AZ (US)

(73) Assignee: MEDIPACS, INC., Tucson, AZ (US)

( * ) Notice: Subject to any disclaimer, the term of this patent is extended or adjusted under 35 U.S.C. 154(b) by 0 days.

(21) Appl. No.: 14/071,371

(22) Filed: Nov. 4, 2013

(65) Prior Publication Data

US 2014/0161628 A1 Jun. 12, 2014

Related U.S. Application Data

(62) Division of application No. 10/786,718, filed on Feb. 24, 2004, now abandoned.

(60) Provisional application No. 60/448,771, filed on Feb. 24, 2003.

(51) Int. Cl.

| | |
|---|---|
| ***F04B 17/03*** | (2006.01) |
| ***F04B 35/04*** | (2006.01) |
| ***F16K 11/20*** | (2006.01) |
| ***F04B 49/06*** | (2006.01) |
| ***F04B 43/04*** | (2006.01) |
| ***F04B 43/08*** | (2006.01) |
| ***F04B 43/09*** | (2006.01) |

(52) U.S. Cl.

CPC ..... *F04B 49/065* (2013.01); *F04B 43/043* (2013.01); *F04B 43/082* (2013.01); *F04B 43/09* (2013.01)

(58) Field of Classification Search

USPC ..... 417/322, 410.1, 413.1, 413.2; 137/597

See application file for complete search history.

(56) References Cited

U.S. PATENT DOCUMENTS

| | | | | |
|---|---|---|---|---|
| 3,029,743 | A | 4/1962 | Johns | 103/150 |
| 4,034,380 | A | 7/1977 | Isayama | 347/19 |
| 4,395,719 | A | 7/1983 | Majewski et al. | 346/140 |
| 4,432,699 | A | 2/1984 | Beckman et al. | 417/63 |
| 4,808,084 | A | 2/1989 | Tsubouchi et al. | 417/322 |
| 4,842,493 | A | 6/1989 | Nilsson | 417/322 |
| 5,192,197 | A | 3/1993 | Culp | 417/322 |
| 5,192,298 | A | 3/1993 | Smith et al. | F04B 35/04 |

(Continued)

FOREIGN PATENT DOCUMENTS

| | | | |
|---|---|---|---|
| CA | 2 477 181 | 4/2004 | |
| CN | 1080829 | 3/2002 | F04B 35/00 |

(Continued)

OTHER PUBLICATIONS

Canadian Official Action issued in Appln. No. 2,557,325, dated Feb. 8, 2011 (5 pgs).

(Continued)

*Primary Examiner* — Charles Freay
(74) *Attorney, Agent, or Firm* — Hayes Soloway P.C.

(57) ABSTRACT

A pump system containing no external parts or valves is provided. The pump system is characterized by a common type of actuating mechanism and incorporates reversibly expanding actuators, preferably electroactive actuators. Fluid is caused to move at a selected flow rate and direction by sequentially activating contiguous actuators located inside the pump. The pump may be used to pump a variety of fluids and may be used in various industrial, commercial, medical, aeronautical, or military applications.

17 Claims, 11 Drawing Sheets

(56) References Cited

U.S. PATENT DOCUMENTS

| | | | | |
|---|---|---|---|---|
| 5,327,041 | A | 7/1994 | Culp | 310/328 |
| 5,622,482 | A | 4/1997 | Lee | 417/321 |
| 5,630,709 | A | 5/1997 | Bar-Cohen | 417/322 |
| 5,798,600 | A | 8/1998 | Sager et al. | 310/330 |
| 5,961,298 | A | 10/1999 | Bar-Cohen et al. | F04B 17/00 |
| 5,979,892 | A | 11/1999 | Smith | 271/267 |
| 6,004,115 | A | 12/1999 | da Costa | F04B 17/00 |
| 6,074,178 | A | 6/2000 | Bishop et al. | 417/322 |
| 6,074,179 | A | 6/2000 | Jokela et al. | 417/322 |
| 6,106,245 | A | 8/2000 | Cabuz | 417/322 |
| 6,109,852 | A | 8/2000 | Shahinpoor et al. | 414/1 |
| 6,143,138 | A | 11/2000 | Becker | 204/157.15 |
| 6,184,608 | B1 | 2/2001 | Cabuz et al. | 310/309 |
| 6,213,739 | B1 | 4/2001 | Phallen et al. | 417/478 |
| 6,249,076 | B1 | 6/2001 | Madden et al. | 310/363 |
| 6,392,777 | B1 | 5/2002 | Elliott et al. | 359/244 |
| 6,450,773 | B1 | 9/2002 | Upton | 417/53 |
| 6,464,476 | B2 | 10/2002 | Ross et al. | 417/478 |
| 6,475,639 | B2 | 11/2002 | Shahinpoor et al. | 428/614 |
| 6,490,483 | B2 | 12/2002 | Willis | 604/20 |
| 6,578,245 | B1 | 6/2003 | Chatterjee et al. | 29/25.35 |
| 6,664,718 | B2 | 12/2003 | Pelrine et al. | 1/1 |
| 6,682,318 | B2 | 1/2004 | Takeuchi et al. | 417/322 |
| 6,682,500 | B2 | 1/2004 | Soltanpour et al. | 604/9 |
| 6,685,442 | B2 | 2/2004 | Chinn et al. | 417/321 |
| 7,820,427 | B2 * | 10/2010 | Unger et al. | 435/286.5 |
| 2002/0173745 | A1 | 11/2002 | Santini et al. | 604/67 |
| 2004/0112442 | A1 * | 6/2004 | Maerkl et al. | 137/597 |
| 2004/0234401 | A1 | 11/2004 | Banister | 417/474 |
| 2008/0091139 | A1 | 4/2008 | Srinivasan et al. | 604/68 |

FOREIGN PATENT DOCUMENTS

| | | | |
|---|---|---|---|
| DE | 199 12 606 | 12/2000 | F04B 43/04 |
| WO | WO97/42412 | 11/1997 | F04B 43/12 |
| WO | WO 96/17170 | 6/1999 | F04B 35/00 |
| WO | WO2004/031581 | 4/2004 | |
| WO | 2006/065884 | 6/2006 | |

OTHER PUBLICATIONS

European Official Action issued in Appln. No. 04714231.0-2315/1611353, dated Oct. 4, 2010 (4 pgs).

European Official Action issued in Appln. No. 04714231.0, dated May 11, 2011 (2 pgs).

European Search Report dated Feb. 18, 2011 issued in corresponding Appln. No. 10014840.2-2315 (7 pgs).

Official Action issued Nov. 12, 2012 in U.S. Appl. No. 12/745,880 (26 pgs).

Official Action received in corresponding Chinese Application No. 200480010203.3.

Official Action received in corresponding EPO Application No. 04 714 231.0-2315.

U.S. Office Action issued Aug. 27, 2010 in related Appln. No. 121/721,800 (13 pgs).

Bar-Cohen, Y., "Electroactive polymers (EAP) actuators as artificial muscles: reality, potential and challenges," SPIE Press, 2001, 671 pgs, (book description only, 4 pgs).

"ElectroActive Polymers—EAPs," downloaded from http://www.azom.com on Dec. 16, 2013 (5 pgs).

* cited by examiner

PULSE ACTIVATED ACTUATOR PUMP SYSTEM

CROSS-REFERENCE TO RELATED APPLICATION

This application is a divisional of U.S. application Ser. No. 10/786,718, filed Feb. 24, 2004, and claims the benefit of U.S. Provisional Application No. 60/448,771, filed Feb. 24, 2003, the contents of which are incorporated herein by reference.

INTRODUCTION

1. Field of Invention

This invention concerns pumps and, more specifically, is directed to a programmable actuator pump system for moving a fluid at a determined rate and in a determined flow path.

2. Background

Many kinds of pumps are known in the art and adaptations have been made for specific applications. Pumps for moving fluids are powered by motors that drive moving components, usually pistons and valves, to produce a force on a fluid that causes it to flow. Valves in such pump systems are generally activated by electromechanical devices such as solenoids and other mechanical components. As one of skill in the art will appreciate, there are countless versions of pumps for many different applications. In the medical device field, e.g., there are peristaltic pumps, diaphragm pumps and centrifuge pumps for delivering blood and other biological fluids for specific purposes. Pumps used in many of today's modern chemical processes, including oil or petroleum refining, food and drug manufacturing and electric generation, rely extensively on a complex interconnection of pumps, piping and valves to effect a particular chemical conversion or mixture. The reliance on multiple dedicated pumps or redundant valve configurations results in complex, expensive systems that require high maintenance and manufacturing costs.

Polymer actuators, requiring no moving parts, are often used in these complex systems to simplify valve operation. A class of actuators, electroactive polymers (EAP—known as artificial muscles), has recently been developed. See, e.g., "Electroactive Polymer (EAP) Activators as an Artificial Muscles" Yoseph bar-Cohen Ed., Society of Photo-Optical Instrumentation Engineers, Publisher (2001). Electroactived polymers reversibly swell or change form when activated. The mechanical force exerted by activated EAP is captured to move components in actuator devices.

U.S. Pat. No. 6,664,718 describes monolithic electroactive polymers that act as transducers and convert electrical energy to mechanical energy. The EAP are used to generate mechanical forces to move components of robots or pumps.

U.S. Pat. No. 6,682,500 describes a diaphragm pump powered by EAP. In this pump, an EAP is positioned beneath a flexible membrane termed a "diaphragm". As the EAP is activated, it swells and contracts and thereby reversibly moves the diaphragm which in turn displaces liquid in which it is in contact. The diaphragm pump uses check-flow valves to control liquid flow.

U.S. Pat. No. 6,685,442 discloses a valve actuator based on a conductive elastomeric polymer gel. In operation, the conductive gel polymer is activated by an electrolyte solution. By manipulating the potential across the gel, the motion of an elastomeric membrane over the expanding gel and the electrolyte solution can be controlled to act as a "gate" to open or close a fluid channel as a check-valve for that channel.

The use of actuators in pump systems reduces the complexity of system operation. Yet each of the disclosed pumps that incorporate polymeric actuators still requires moving parts and valves. The mechanical complexity, maintenance expense, large size and weight, sterility problems, fluid-contaminating erosion products, chemical incompatibility with certain fluids and often noisy operation, make most pump systems unsuitable for certain purposes.

Accordingly, simple actuator devices that use no mechanical parts or valves have been sought.

SUMMARY

Improved pumps and methods of pumping fluids are hereinafter disclosed which overcome many of the disadvantages of prior art pumps, including the use of complex moving parts and the relatively high cost of manufacture.

The present invention contemplates an actuator pumping system that utilizes the force of expanding or deflecting actuators inside a housing of fixed volume to displace liquid through the housing. No moving parts or valves are required. The timed activation of individual actuators causes the actuators to change dimensions at a determined time and sequence and thereby cause the fluid to flow at a certain time and path.

The present pump system for moving a fluid comprises an actuator housing having a chamber for housing the fluid, a plurality of contiguous actuators located in the chamber, and activating means for sequentially activating individual actuators. Each actuator, when activated, changes dimensions and exerts a displacing force on the housed fluid.

In preferred embodiments of the present invention, the actuator housing comprises two or more chambers in fluid connection. In certain instances, the separate chambers may be programmed to displace different segments of fluid at individualized rates and flow paths The separate chambers may, e.g., be used to modify flow rates of fluids that change viscosity while moving through the housing. In other instances, coordination of flow rate through the separate chambers may be used to subdue any pulsing flow patterns from individual chambers into a smooth continuous fluid flow pattern downstream from the chambers.

Preferably the pump comprises a means for controlling the actuator activating means whereby individual actuators are activated at a determined time. The controller in preferred embodiments is a programmable microprocessor in electrical connection with the activating means.

In certain instances, the pump comprises a sensor means for determining physical properties of the fluid. The sensor is in electrical connection with the controlling means and provides feed-back about the physical state of the fluid to the controlling means. The sensor may, for example, measure changes in pH, viscosity, ionic strength, velocity, pressure or chemical composition of fluid. This feed-back allows the pump to interactively alter fluid flow rate and direction.

In preferred embodiments of the present invention, the pump moves a fluid at a controlled rate. In these embodiments, the activating means sequentially activates individual contiguous actuators at a selected time. The rate at which the fluid flows depends on the rate of actuator activation and volume displaced by each actuator. Thus, in certain preferred instances, the individual actuators are repeatedly pulsed sequentially at rapid intervals, and liquid is essentially spurted from the housing. In other instances, a first group of contiguous actuators is activated at a certain time and then, while the first group return to their original dimensions, a second group of contiguous actuators is sequentially activated. Repetition of this activation pattern for several times or with more groups of actuators along the fluid flow path causes a volume of fluid to be displaced and eventually to be ejected from the housing. The amount of fluid displaced in a given time is determined by the difference in volume between activated actuators and restored activators.

The chamber in the actuator housing is sufficiently rigid to prevent it being deformed by the force exerted by activated actuators, since the displacing force of the activated actuators requires the chamber to maintain an essentially constant volume. In certain instances, however, as when the pump is to be placed into a small cavity, the actuator housing may be slightly deformable while being inserted.

In other preferred embodiments of the present invention, the direction of fluid flow inside the actuator housing is controlled. In these embodiments, the location of individual actuators in the chamber determines the flow path of the displaced liquid. A fluid directed through the chamber will flow into spaces that contain no actuator to bar fluid flow. In certain preferred instances, the individual actuators are located in a grid pattern within the chamber with individual actuators positioned at the intersection of each grid line. In these instances, a fluid flowing through the grid will move into unobstructed spaces as defined by the position of actuators in the grid, but will not flow into volumes barred by actuators. Other actuator patterns may be designed to cause different flow paths. Most preferably the pumps in these embodiments comprise sensors for determining properties of the fluids. Pump controllers may be programmed to respond to feedback from the sensors and activate selected actuators and thus interactively determine the fluid flow path.

In certain instances, the chamber may comprise more than one inlet port for receiving different fluids with each fluid being directed into separate paths. In these instances, the pump may be used as a fluid mixing device by making the flow paths of different fluids intersect. The mixed fluids may be allowed to react and are then directed to an exiting flow path.

In other preferred embodiments of the present invention, the pumps move fluids at both a determined rate and in a determined path. In these instances, the rate and pattern of sequential activation of actuators in the pump determines the rate of fluid flow and the positioning of actuators in the chamber of the actuator housing determines the flow path.

The actuators for use in the present invention are preferably essentially inert and non-reactive with the fluid. In those instances wherein the pump is used for moving a biological fluid, blood e.g., the actuators are biocompatible with the fluid. In other instances the chamber comprises an elastomeric impermeable lining located between the actuators and the housed fluid to prevent contact of actuators and fluid.

In preferred embodiments of the present invention, each individual actuator is encased in an essentially inert material to protect it from contact with fluid and, in certain instances, from interaction with contiguous actuators. The individual actuators when encased are individual integral cells inside the actuator housing.

The actuators of the present pump are most preferably comprised of elastomeric materials responsive to an activating means. The elastomeric material changes its dimensions when activated. In certain instances the material expands and, due to the barrier to expansion exerted by contiguous actuators, moves linearly outward into a space occupied by the housed fluid and thereby displaces the fluid. In certain other instances, activation of the polymer causes it to contract into a smaller volume, making the space above it open for fluid flow. In certain other instances the elastomeric material changes shape. As the shape change occurs, the elastomeric material pushes and displaces the liquid. It is an essential aspect of the present invention that the actuators quickly revert to their original shape when not activated. It is the reversible nature of the actuators that supports the pumping action.

Most preferably the actuators in the pump of the present invention are reversibly responsive elastomeric materials selected from the group consisting of electroactive polymers, electrolytically activated polymer gels, optically activated polymers, piezoelectric polymers, piezoelectric ceramic materials, chemically activated polymers, magnetically activated polymers, thermally activated polymers and shape memory polymers. The shape and size of the actuators is determined by the dimensions of the chamber, the amount of size change when the actuators are activated and the nature of the fluid being moved.

In preferred embodiments of the present pump, the actuators comprise electroactive polymers. In certain instances, the activating means is an electrical circuit that directly triggers individual actuators to change dimensions at a determined time and pattern. Chemical changes such as pH, ionic strength or phase changes in the electroactive polymers resulting from direct electrical activation cause the actuators to change size or shape. Piezoelectric polymers and polymers fitted with electrical contacts are examples of actuators suitable for use in these embodiments. In embodiments with electroactive polymers, each actuator is electrically shielded from contiguous actuators.

In other preferred embodiments of the pump of the present invention, the actuators are electrolytically activated polymer gels that are activated by contact with an electrolytic solution. In these embodiments, individual polymers are each encased with a semi-permeable material, the actuator housing comprises a reservoir for housing electrolytic solution and the activation means is an electrical circuit whereby electrolytic solution is caused to flow reversibly through the semi-permeable material from the reservoir into contact with and away from the polymer to cause reversible movement of the actuator.

In those preferred embodiments wherein actuators are activated by an electric circuit either directly or by electrolyte, the pump preferably comprises a remote control device for driving the circuit. Most preferably the remote control device is infra-red or radio-frequency driven. In certain preferred embodiments the remote control device is driven by a microprocessor programmed to operate the pump at a selected time and sequence.

In other preferred embodiments of the pump of the present invention, the actuators comprise optically responsive polymers. In certain preferred instances, the optically responsive polymers are ionized in the presence of light. In other preferred instances, the optically responsive polymers change pH in the presence of light. The activation of the optically responsive polymers is controlled by exposure to a laser beam of specific wavelength, to natural light, to a LED or to other quantum light sources. In certain preferred instances, the time of exposure is controlled by a remote control device, an infra-red or radio-frequency driven device, e.g. In these preferred embodiments the remote control device is driven by a microprocessor programmed to activate the actuators at a selected time and sequence.

In one embodiment of the present invention, the pump may be used as a fluid mixing device. These embodiments are especially useful in chemical processing or bio-processing systems. For chemical processing, the device may accommodate more than one fluid and each fluid may be caused to flow in a chosen flow path into a reservoir and then out from the reservoir as a single fluid. In bio-processing systems the device may be used as a gentle cell processing device.

In other embodiments, the pump may be used as a portable fluid delivery device. Because the pump is simple and comprised of lightweight components, it is useful in stealth operations.

In another embodiment, the pump may be used as an infusion pump for delivering a medicament to an individual in need thereof. The infusion pump may be manufactured at low cost and therefore be disposable after a single use. In other instances, the infusion pump may be very small and of a size permitting implantation in the individual if necessary. Such devices may comprise a fluid sensing device and are especially useful for controlled delivery of insulin to diabetics.

In yet another embodiment, the pump may be used as a drug delivery device for delivering a liquid drug or drug solution at a controlled rate and at a controlled time to an individual in need thereof. The delivery device may be used to deliver medicaments to humans, dogs, cats and other animals. In certain embodiments of the drug delivery device, the actuator housing comprises a single outlet port but no inlet port and houses the liquid drug or drug solution to be delivered. These devices may be preloaded with drug or drug solution and may be kept sterile until use.

In other preferred embodiments of the present invention, the pump may be used to propel an object along a surface. In these embodiments, the pump comprises an actuator housing in contact with the object, a plurality of contiguous actuators in contact with the actuator housing and in contact with the surface, and activating means for sequentially activating individual actuators. In this embodiment, when each actuator is activated, it changes shape and exerts a displacing force on the surface and thereby propels the solid object in a direction opposite that of the displacing force. The propelling pump may be used to propel an object suspended on a liquid surface, on a solid surface or for propelling an object submerged in a liquid.

The present invention also sets forth methods for pumping a fluid at a controlled rate. In the methods, the actuator housing of the present pump is placed into fluid contact with fluid to be pumped, a first actuator is activated to prevent back-flow from the actuator housing and then the contiguous actuators are repeatedly activated at a sequence wherein activation of one of the individual actuators occurs at a time after one of its contiguous actuators has been activated.

The methods may be used to pump fluids of different viscosities. In these methods, the pump comprises two or more chambers in fluid connection and each chamber is operated at a different flow rate by activating the actuators therein at different times and sequences.

BRIEF DESCRIPTION OF THE DRAWINGS

The above and other aspects, features and advantages of the present invention will be more apparent from the following more particular description thereof, presented in conjunction with the following drawings wherein:

In FIG. 2*a* the contiguous actuators are located in a linear array in the chamber. In this embodiment, the actuators, when activated, expand to the opposite wall of the cavity and form a seal that bars fluid flow and at the same time displace fluid along the axis of the array. FIG. 2*b* illustrates actuators located apposite in two linear arrays. In this embodiment, the actuators, when activated expand into contact one with another. FIG. 2*c* illustrates actuators located in a spiral array along the axis of flow inside the cavity. This array is useful for vertical movement of fluid.

FIG. 8 illustrates possible placements of contiguous actuators 17 in chamber 14.

FIG. 10 illustrates the pump as a propulsion device.

Figure 1:
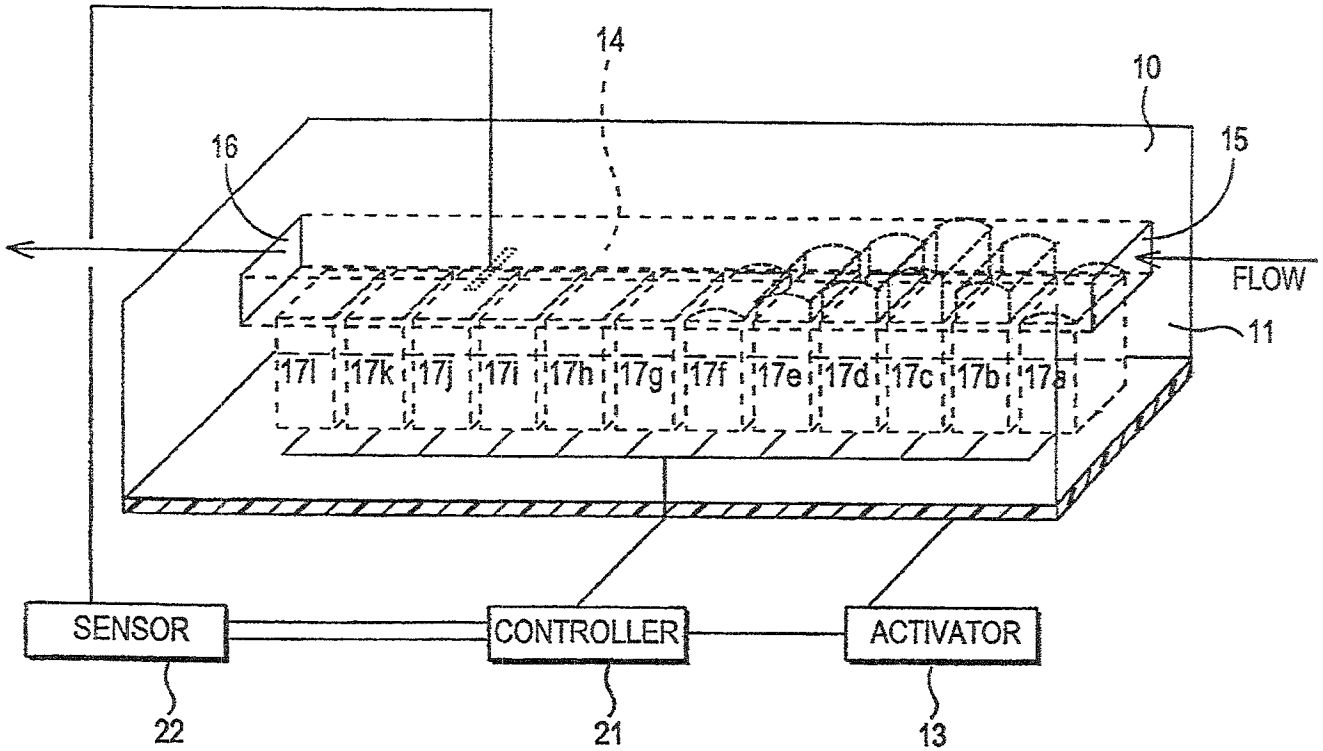
FIG. 1 illustrates the pump of the present invention depicting the actuator housing with a chamber for housing the fluid, a plurality of contiguous actuators in the chamber, and activating means for sequentially activating individual actuators. A controller for activation means and a fluid sensor are illustrated. Flow of fluid through the housing is depicted. In operation, the individual actuators are activated at a time and in a sequence that causes fluid flow at a determined rate and path.

Other features and advantages of the present invention will be apparent from the following detailed description, the accompanying drawings and the appended claims.

DETAILS OF THE INVENTION

Definitions

"Activating means" refers generally to the means by which the polymeric actuators are caused to change dimensions. In the case of electroactive polymeric gels that are activated directly, the activating means is a switching means that triggers the electrical circuit that causes electric activity resulting in the chemical action in the polymer that causes dimension change in the polymer. In the case of electroactive polymeric gels that are activated indirectly, the activation means causes flow of electrolytic solution into contact with the polymer and then away from polymer. In the case of light-activated polymers, the activating means is the switching means that allows light to contact the polymer. In the case of piezoelectric actuators, the switching means is generally the switching means that electrical or physical pressures to the piezoelectric material.

"Controlling means" refers to controllers in electrical contact with the activating means. Preferably the controlling means is an electronic device that is programmed to provide activation of activating means at a chosen time and sequence. Most preferably the controlling means comprises a programmed microprocessor. Microprocessor chips are well-known in the art. A simple chip is inexpensive and is preferably used in embodiments of the present invention that are disposable.

"Fluid" refers to liquids, slurries, fine powders, emulsions and mixtures of solvents. In certain instances the fluid may be a gas.

"Microprocessor" means computer as well as the CPU in the computer. Preferably the microprocessor is a small chip that may be programmed to run the pump at a selected time and sequence. The microprocessor may interactively respond to the sensor. Certain chips that are very inexpensive to manufacture are quite suitable for disposable embodiments of the present pump.

"Sequential activation" means a pattern of activation of contiguous actuators wherein neighboring actuators are activated one after the other. In an array of contiguous actuators, activation of the first actuator determines a volume of fluid to be displaced. Activation of the neighboring actuators will displace this volume. Repetition of activation sequentially will continue to move this volume along the surface of contiguous actuators through the chamber. The sequential activation of contiguous actuators resembles the sounding of keys on a piano board when a musical scale is played. The present pump however is not limited to a flat linear array of actuators. A tubular chamber may, e.g. comprise actuators in a spiral array. In certain embodiments, a combination of multiple actuators may be activated at the same time to displace a greater volume of fluid and increase flow rate. In these embodiments, "sequential" means activation of contiguous sets of actuators.

Actuators for use in the present invention preferably comprise electroactive polymers (EAP). These polymers respond to external electrical stimulation by displaying a significant shape or size change. EAPs fall into two major categories: electronic and ionic Electric field or Coulomb forces generally drive electronic EAPs, while the primary driver for ionic EAPs is the mobility or diffusion of ions.

Types of electronic EAP include ferroelectric polymers, dielectric polymers, electrorestrictive graft polymers, electrostrictive paper, electrovasoelastic polymers and liquid crystal elastomer (LCE) materials. Ionic EAPs include Polymer Gels (IPG), Ionomeric Polymer-Metal Composites (IPMC) Conductive Polymers (CP) and Carbon Nanotubes (CNT). The following Table I on ionic EAPs may be found on the AZom website at http://www.azom.com/details.asp?ArticleID=885#_Ferroeletric_Polymers:

TABLE I

| Polymer Gel (IPG) |
|---|
| These are polymer gels having the potential of matching the force and energy density of biological muscles. The polyacrylonitrile materials are activated by chemical reaction(s), a change from an acid to an alkaline environment inducing an actuation through the gel becoming dense or swollen. The actuation is somewhat slow due to the diffusion of ions through the multilayered gel. |
| Ionomeric Polymer-Metal Composites (IPMC) |
| These are EAPs that bend in response to an electrical activation as a result of the mobility of cations in the polymer network. Generally, two types of base polymers are employed to form IPMCs these are Nafion ® (perfluorosulphonate manufactured by Du Pont) and Flemion ® (perfluorocaboxylate manufactured by Asahi Glass, Japan). IPMC require relatively low voltages to stimulate a bending response (1-10 V) with low frequencies below 1 Hz. |
| Conductive Polymers (CP) |
| CPs actuate via the reversible counter-ion insertion and expulsion that occurs during redox cycling. Significant volume changes occur through oxidation and reduction reactions at corresponding electrodes through exchanges of ions with an electrolyte. Electrodes are commonly fabricated from polypyrrole or polyaniline, or PAN doped with HCl. CP actuators requires voltages in the range of 1-5 V. Variations to the voltage can control actuation speeds. Relatively high mechanical energy densities of over 20 J/cm3 are attained with these materials, however, they posses low efficiencies at levels of 1%. Other material combinations for CP are polypyrrole, polyethylenedioxythiophene, poly(p-phenylene vinylene)s, polyaniline and polythiophenes. Some applications reported for these CPs aro miniature boxes that have the ability to open and close, micro-robots, surgical tools, surgical robots that assemble other micro-devices. |
| Carbon Nanotubes (CNT) |
| In 1999, CNTs emerged as formal EAPs with diamond-like mechanical properties. The actuation mechanism is through an electrolyte medium and the change in bond length via the injection of charges that affect the ionic charge balance between the nanotube and the electrolyte. The more charges that are injected into the CNT the larger the dimension change. As a consequence of the mechanical strength and modulus of single CNTs and the achievable actuator displacements, these EAPs can boast the highest work per cycle and generate much higher mechanical stresses than other forms of EAPs. |

As can be observed in Table I, the mechanical properties and chemical mechanism of the ionic EAPs vary considerably. For use in the present invention, EAPs that exhibit significant and reversible volume changes when activated are preferred. Examples of preferred polymers with a significant bending response include the base polymers Nafion® (perfluorosulphonate manufactured by Du Pont) and Flemion® (perfluorocaboxylate manufactured by Asahi Glass, Japan).

A second category of actuators that may be used in preferred embodiments of the invention comprise photo-activated polymers termed photo-actuators. Photo-actuators cause changes in the length and volume of an illuminated material. Examples of mechanisms behind photoactivsation include phase transitions, internal restructuring (isomerization) in polymers, and photostriction (a combination of the photovoltaic and piezoelectric effect).

U.S. Pat. No. 6,143,138 discloses light activated polymers useful as actuators in the present invention. The polymer comprises a pH jump molecule, preferably anthracene. Visible light is used to excite the pH jump molecule. The attendant pH change occurs rapidly (in nanoseconds) and can be maintained by continuous wave light or by an appropriately pulsed light.

Suitable polymers for use as the present actuators are well known, and new materials are continuously being discovered that will be suitable actuators. A review of electroactive polymers may be found in "Electroactive Polymer (EAP) Activators as an Artificial Muscles" Yoseph bar-Cohen Ed., Society of Photo-Optical Instrumentation Engineers, Publisher (2001) herein incorporated in its entirety.

Although certain reversibly expanding polymers suitable for use as actuators in the present invention have herein been disclosed, any materials having specifications including reversible, quick shape and volume changes when activated, low voltage requirements, good strain and robustness will be suitable. It is intended that the scope of the present invention extends to new materials that will be developed that exhibit the required specifications.

FIGS. 1-10 show generally the preferred embodiments of the pump of the present invention designated by the numeral 10.

Referring now to FIG. 1, Pump 10 includes actuator housing 11, chamber 14, a plurality of contiguous actuators 17 located in chamber 14, and activating means 13 for sequentially activating individual actuators 17. The actuator housing may have one or more inlet ports 15 and one or more outlet ports 16.

Also illustrated in FIG. 1, is controller 21. Controller 21 controls activating means 13 and establishes the times at which individual actuators are activated sequentially. Such controllers are well known in the art. Preferably the controller 21 is a programmable microprocessor, most preferably a simple programmable microchip in electrical connection with the activating means.

Also illustrated in FIG. 1 is a sensor 22 for determining certain physical properties of the fluid wherein the sensor is in electrical connection with the controlling means and is capable of delivering signals received from the fluid to the controlling means. Sensors for the purpose are well known in the art and may respond to physical properties of the fluid including chemical composition, pH, pressure, temperature and flow rate.

Figure 2A:
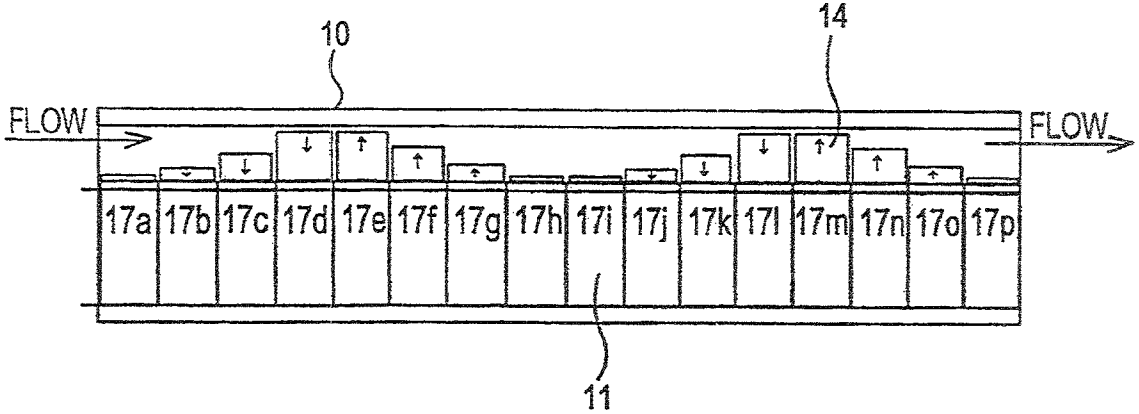
FIGS. 2*a*-2*c* illustrate possible arrangements of contiguous actuators in the chamber.
Figure 2B:
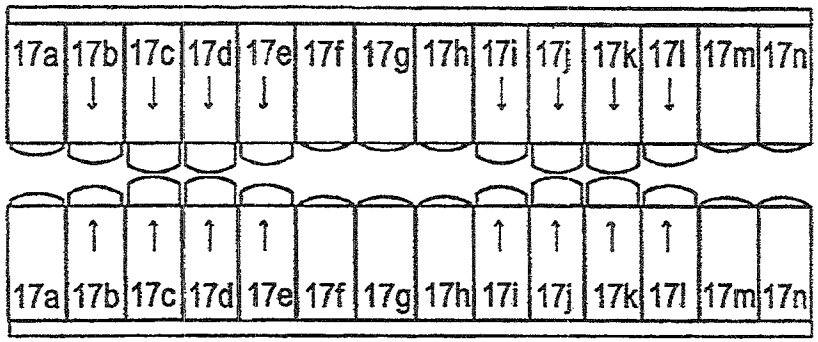
Figure 2C:
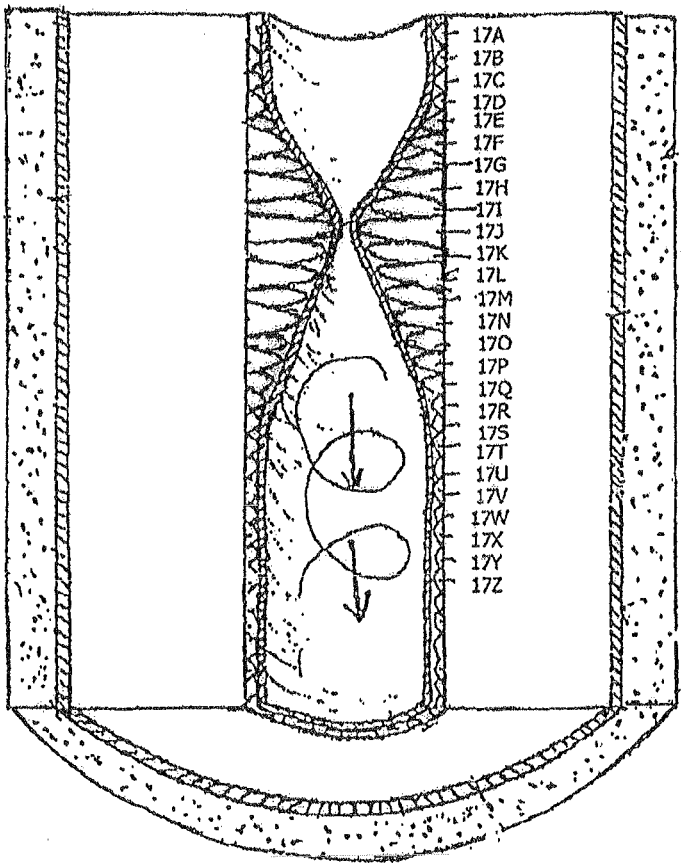

FIGS. 2*a*-2*c* illustrate possible arrangements of contiguous actuators in the chamber 14. In FIG. 2*a* the contiguous actuators 17*a*-*p* are located in a linear array in the chamber 14. In this embodiment, the actuators, when activated, expand to the opposite wall of the chamber and form a seal that bars fluid flow and at the same time displace fluid along the axis of the array. FIG. 2*b* illustrates actuators 17*a*-*n* located opposite in two linear arrays. In this embodiment, the actuators, when activated, expand into contact one with another. FIG. 2*c* illustrates actuators 17*a*-*z* located in a spiral array along the axis of flow inside the cavity. In this embodiment, the actuators, when activated expand into contact with the opposite wall. This array is useful for vertical movement of fluid along the axis of the flow in the actuator housing. These examples are illustrative of actuator positioning, but other positions that provide for contact of expanded actuators with a solid surface to displace fluid are possible.

Displacement of fluid is achieved by activating each contiguous actuator individually in a sequential time pattern. The elastomeric materials in the actuators, upon activation, change dimensions and exert a force on the volume of liquid in which they are in contact. The force exerted by each actuator in a contained fluid is multi-directional, and although the fluid is displaced, there is no flow created. Fluid movement is achieved in the present invention by activating contiguous actuators sequentially to cause individual actuators to expand to an opposite surface and displace the volume of liquid corresponding to the expanded size of actuator. A first actuator in the array is activated, expands to an opposite surface and exerts force on the fluid. Fluid displaced by this first actuator will move in forward and backward directions relative to the actuator. But when the second actuator, which is contiguous to the first actuator, is activated, it displaces fluid in one direction only because the other three directions are blocked by the first actuator, an opposing surface and a wall of the chamber to which the actuator is attached. By continuing the sequential activation of contiguous actuators the fluid is forced to flow along the path defined by the actuators and the housing. In preferred embodiments, sets of actuators are position in the chamber along the axis of flow. Repetition of the activation sequence continues with each set until the first set of actuators reverses its shape change and then may be activated again. Reversal of flow may be achieved in the present pump by reversing the sequence of activation of the individual actuators. Certain polymers contract when activated. When used as actuators in the present invention, the extended first actuator is placed at the entry port of the chamber. The activation pattern begins by contraction of the first actuator followed by sequential contraction of contiguous actuators. Fluid flows along the path defined by the actuators.

Figure 3:
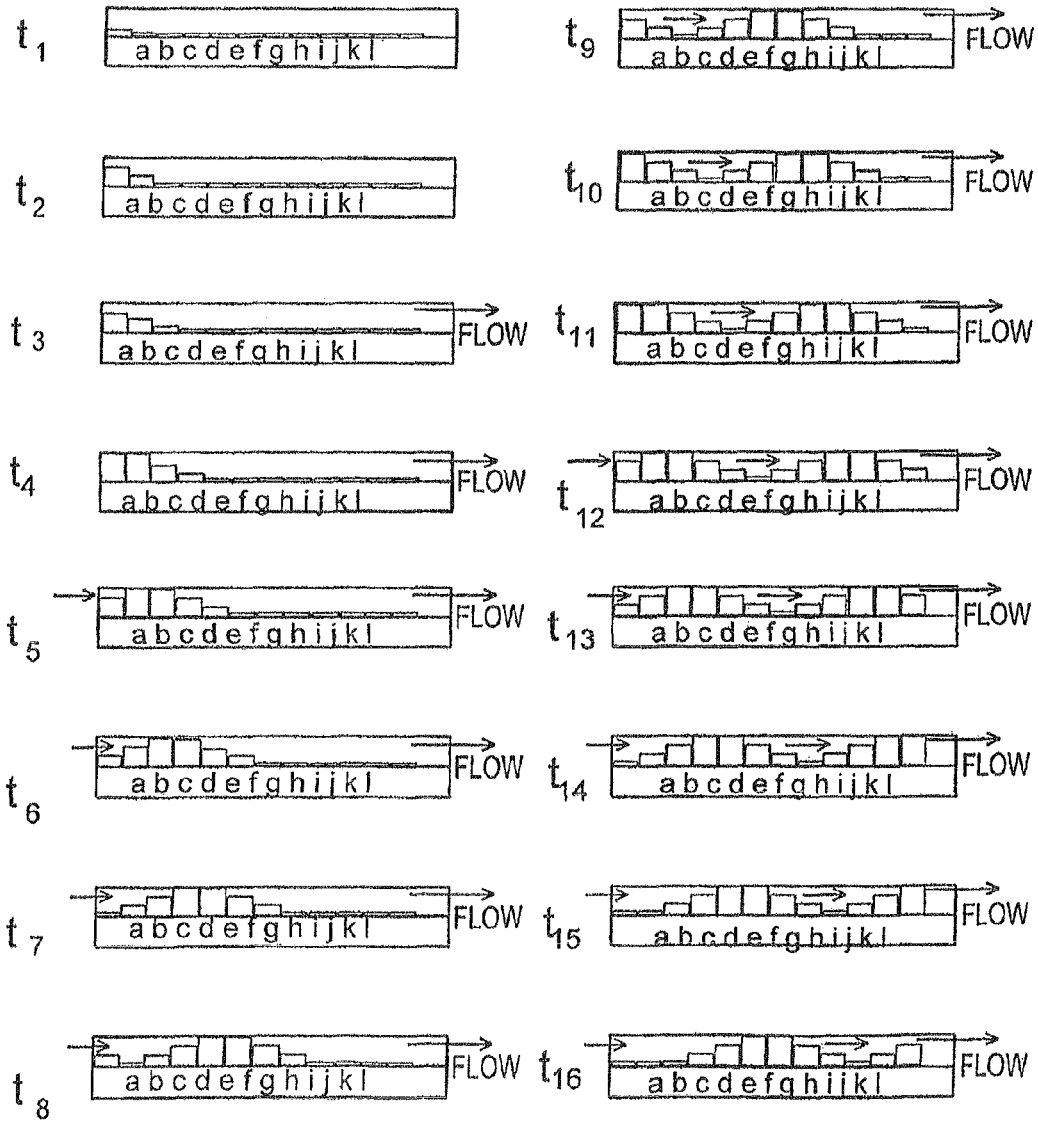
FIG. 3 illustrates the pump with a plurality of sets of contiguous actuators in the chamber. Fluid flow caused by sequential activation of the contiguous actuators is indicated.

FIG. 3 illustrates the pump 10 with a plurality of contiguous sets of contiguous actuators, set 17*a*-*f* and set 17*g*-*l* arranged in sequence in chamber 14. Each frame demonstrates the positions of the actuators for each successive unit of time, $t_1$ through $t_{16}$. Fluid flow in this illustration occurs in phases wherein, in a first phase, the first set of actuators 17*a*-*f* is sequentially activated and in a second phase the second set of actuators 17*g*-*l* is then sequentially activated. The volume of liquid displaced by the first set 17*a*-*f* will flow into position above the second set 17*g*-*l*. Repetition of these phases results in pulsed flow of liquid through and out of the actuator housing.

The rate of flow through the actuator housing 11 is determined by the selected time and sequence of activation of the actuators. Calculation of expected flow rate may be made from the change in dimensions of the actuators. The amount of fluid displaced at a given time is the sum of the total volume of all the expanded (or contracted) actuators during this time. The rate of fluid flow is the volume displaced during a given time which is determined by the time and sequence of activation. The controller 21 may be programmed to activate the actuators at a given time and sequence to provide a selected flow rate.

Figure 4:
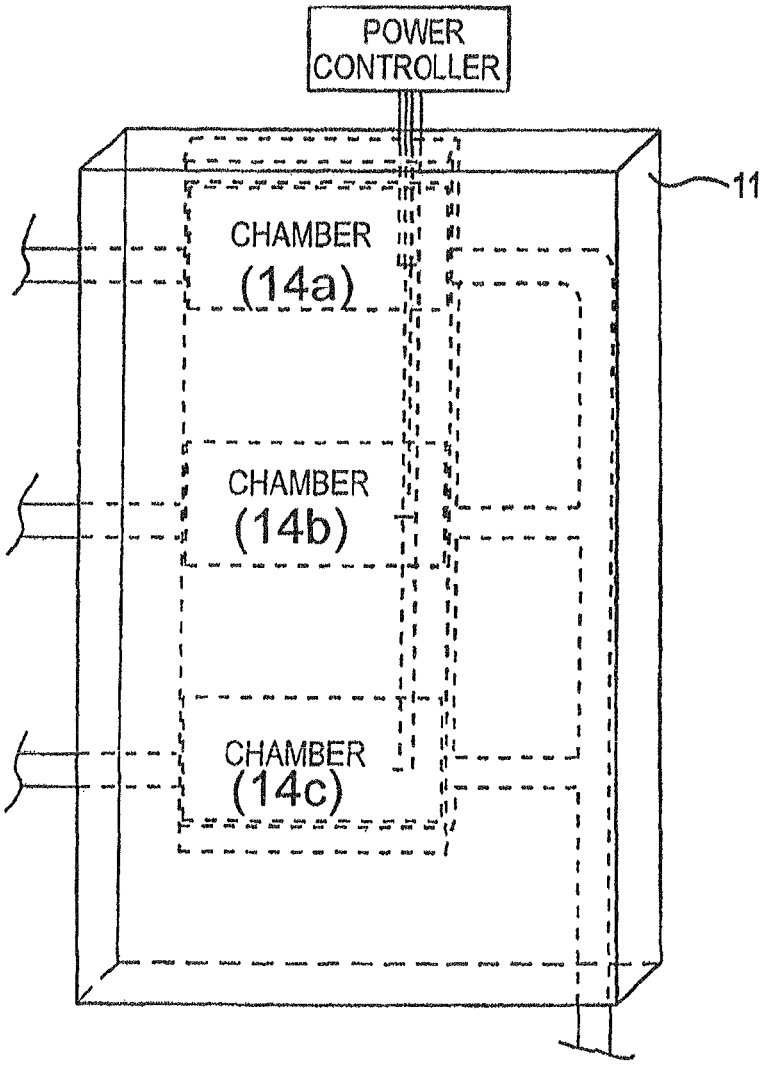
FIG. 4 illustrates the pump of the present invention with three chambers in fluid connection inside the actuator housing.

FIG. 4 illustrates the pump 10 of the present invention comprising three chambers 14*a*, 14*b* and 14*c*. In this illustration the chambers are located in fluid connection. Each chamber may be operated independently of the other so that fluid flow may be initiated at different times and sequences. This arrangement is useful for pumping fluids that may change viscosity during fluid flow. It is also useful for damping a pulsed flow. Dampening may be achieved by positioning the actuators in a parallel arrangement inside the chamber and activating actuators in each housing at a different time.

Figure 5:
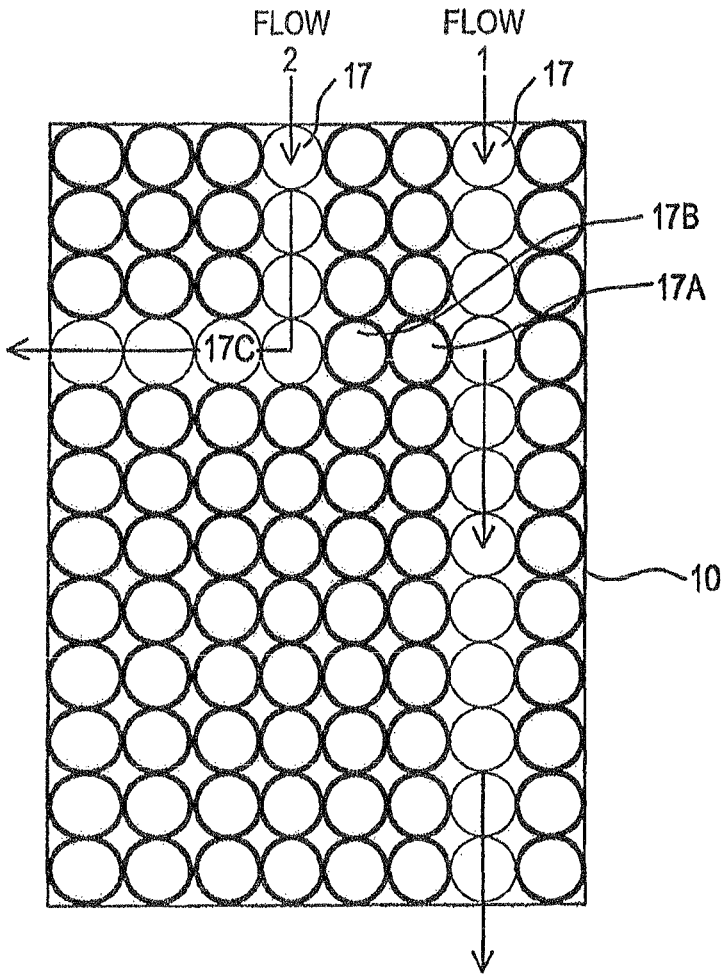
FIG. 5 illustrates the pump for moving a fluid in a determined path wherein the actuators are located in the chamber at positions that define the flow path for the liquid when displaced. In this illustration the contiguous actuators are located at the intersection of grid lines defining a matrix.

FIG. 5 illustrates a preferred embodiment of the pump 10 for moving a fluid in a determined path. Actuators 17 are located in chamber 14 in a pattern that defines the flow path for the liquid. Filled circles indicate activated actuators and empty circles define non-activated actuators. In FIG. 5 individual actuators are located at the intersection of grid lines and a path for fluid 1 and fluid 2 are indicated. Fluid will flow along the paths defined by the empty circles as contiguous activators in the pathway are activated. It is an important aspect of the present invention that fluid may be caused to flow in a desired pattern by the present pump by activating certain actuators at a given time. Thus, as illustrated in FIG. 5 the two fluids may be caused to intersect by allowing actuators 17*a* and 17*b* to change dimensions of the non-activated state and by activating actuator 17*c*. Fluid 2 will move in the new path and will combine with fluid 1. Reaction may occur at the intersection and the new fluid will be directed out of the chamber by sequential activation of the actuators.

Figure 6:
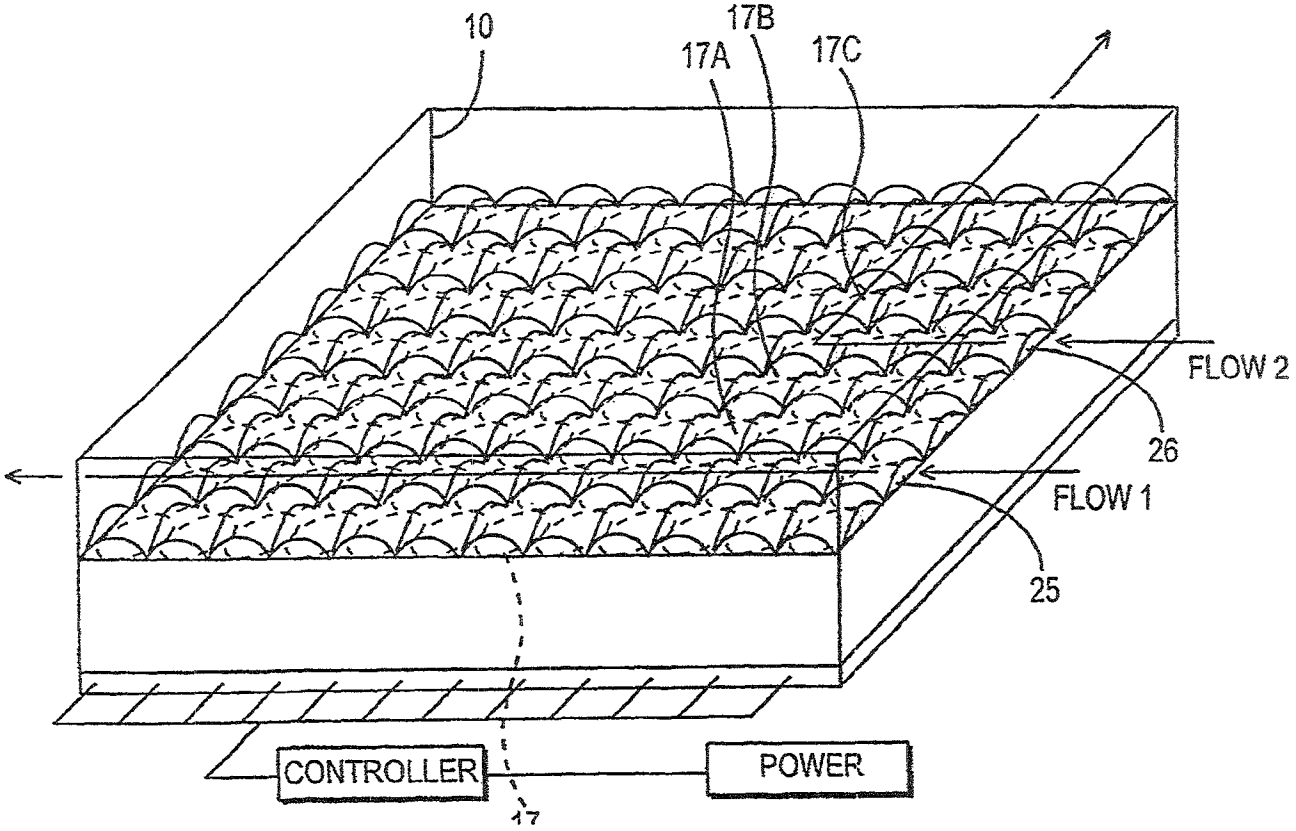
FIG. 6 is an expanded view of the actuators in chamber. The actuators comprise photo-activated polymers and are encased in an inert material. Conduits for access to a photo-source are illustrated. In this embodiment, the fluids may be pumped at a controlled rate and direction. The fluids may be directed to an intersection where they mix and are allowed to react.

FIG. 6 is a view of the actuators in chamber 14 illustrating the individual actuators 17 encased in an inert material 23. The actuators in FIG. 6 comprise photo-activated polymers. Conduits 24 for access to a photo-source are illustrated. In certain embodiments of the pump illustrated in FIG. 6, the actuators may be sequentially activated and fluid flows at a controlled rate. In other embodiments, the actuators may be activated in a pattern that defines flow path of liquid. FIG. 6 also illustrates ports 25 and 26 for receiving two fluids. The fluids may be directed in separate paths, as illustrated. Alternatively, the fluids may be directed to an intersection where they mix and react.

Figure 7:
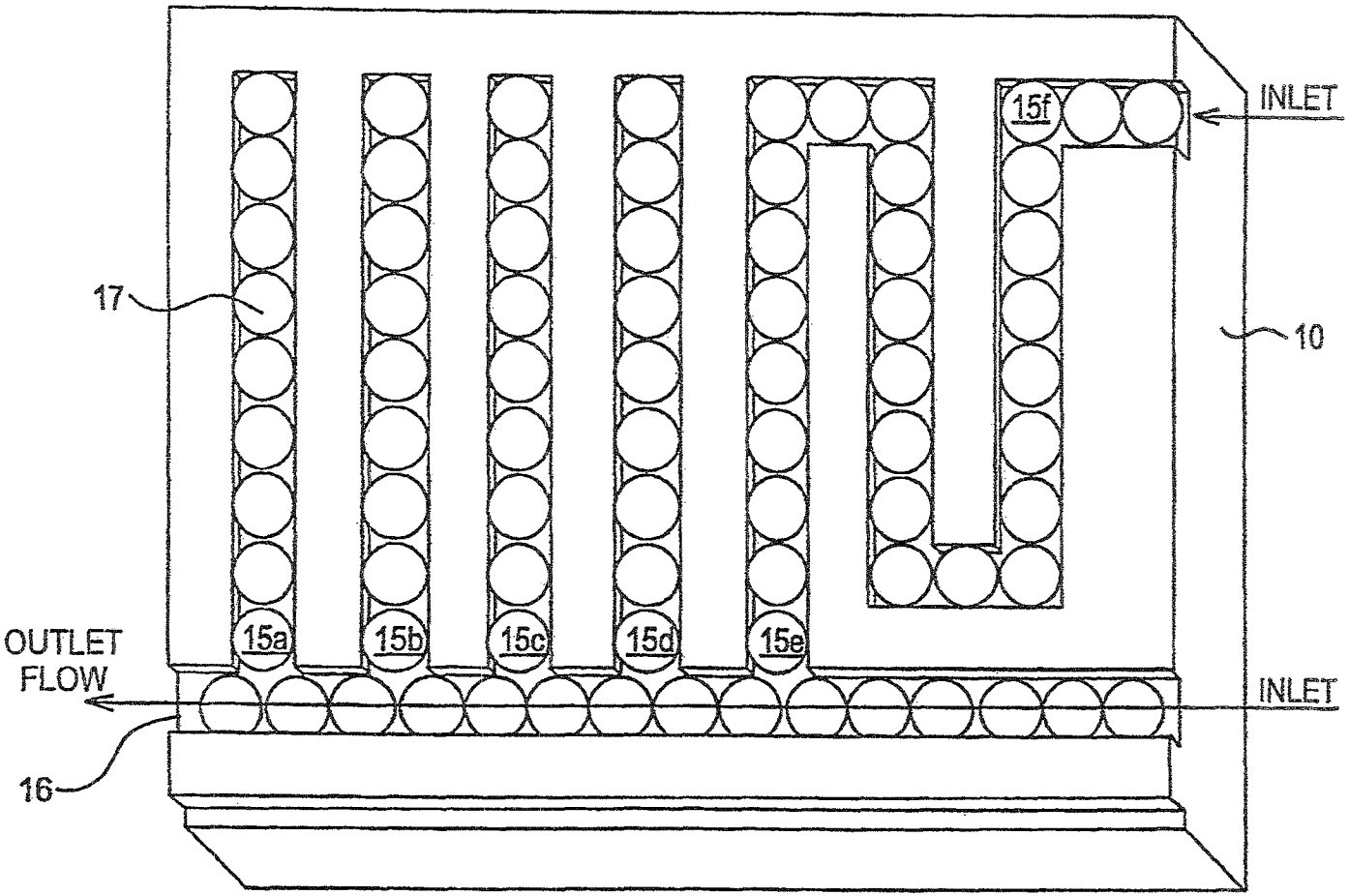
FIG. 7 depicts pump 10 in an on-line processing system wherein various fluids are directed into a main flowing fluid path at a determined time. This pump may be produced as a modular unit for insertion into a chemical or bio-processing system.

FIG. 7 depicts pump 10 in an on-line processing system wherein various fluids are directed into a main flowing fluid path at a determined time. Inlet ports 15*a-e* receive individual fluids. Each fluid is directed in an individual flow path and is delivered to the main fluid at a determined time. Reactive products resulting from reaction between the main fluid and individual fluids exit from exit port 16. This pump may be produced as a modular unit for insertion into a chemical or bio-processing system. The modular unit comprises suitable connectors to achieve fluid connection with the on-line system.

Figures 8A, 8B:
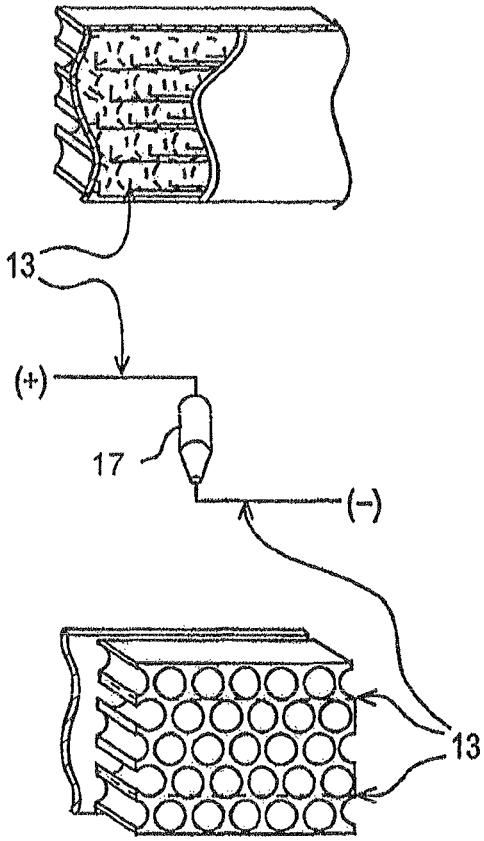
FIG. 8A depicts the actuators on a chamber wall situated so that each actuator expands to an opposite hard surface, an opposite wall of the chamber or another surface in the chamber.
FIG. 8B depicts the actuators situated apposite in the chamber. In this configuration, the actuators will expand into contact with the other.

FIG. 8 illustrates possible placements of contiguous actuators 17 in chamber 14. FIG. 8A depicts the actuators on a chamber wall situated in a position that allows each actuator to expand to an opposite hard surface, such as an opposite wall of the chamber or another surface in the chamber. FIG. 8B depicts the actuators situated apposite in the chamber. In this configuration, the actuators will expand into contact with the other. By placing the actuators opposite one another, actuators having a smaller strain will still effectively displace a large volume of fluid. In other configurations certain actuators may be in an interdigitating pattern. This pattern may be used to provide a mixing of flowing fluid.

Figure 9:
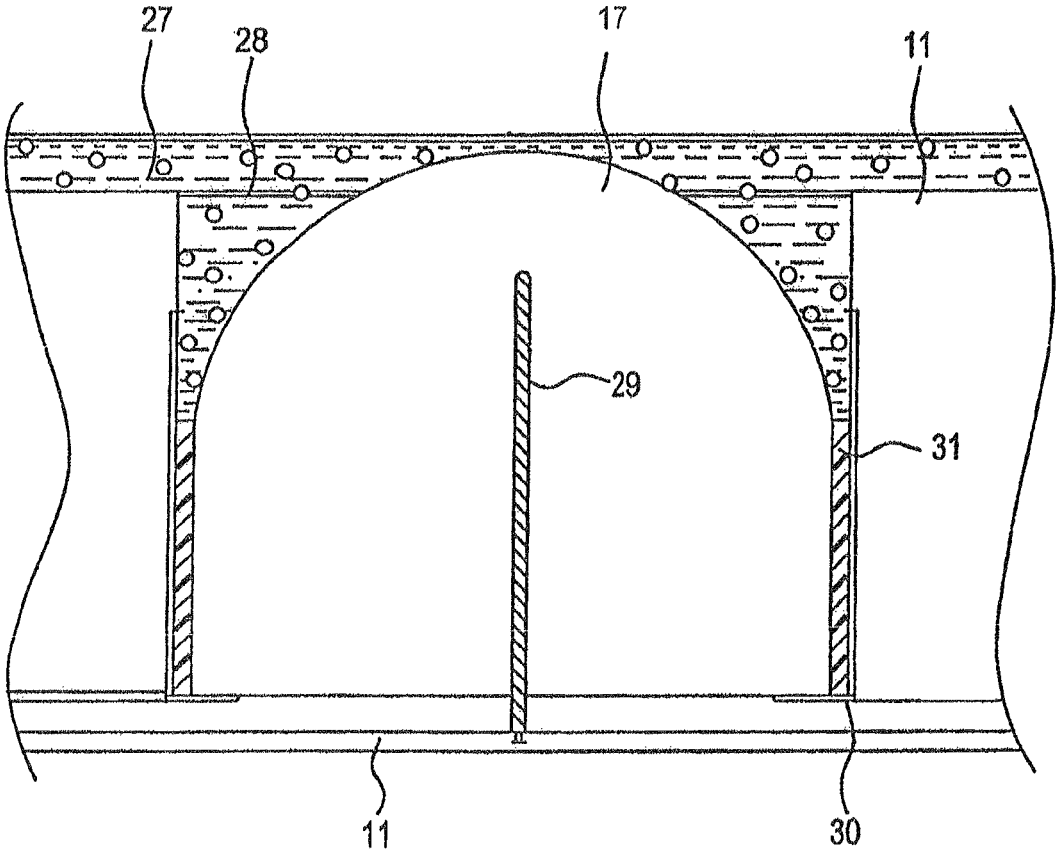
FIG. 9 illustrates pump 10 having electroactive actuators 17 that are activated by contact with electrolytic solution. Actuator housing 11 comprises chamber 14 and reservoir 27 for housing electrolyte solution 28. Electrode 29 is located in the actuator and electrode 30 is located outside the actuator. Frit 31, a semi-permeable grid, separates actuator and electrolyte solution. A semi-permeable membrane 32 surrounds the actuator.

FIG. 9 illustrates pump 10 with electroactive actuators 17 activated by contact with electrolytic solution. Actuator housing 11 comprises chamber 14 and reservoir 27 for housing electrolyte solution 28. Electrode 29 is located in the actuator and electrode 30 is located outside the actuator Frit 31, a semi-permeable grid, separates actuator and electrolyte solution. A semi-permeable membrane surrounds the actuator.

Figure 10A:
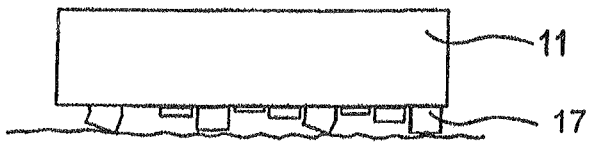
FIG. 10*a* illustrates the pump for moving an object along a surface.
Figure 10B:
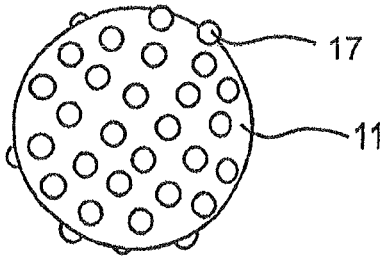
FIG. 10*b* illustrates the pump for moving an object suspended in a liquid.

FIG. 10 illustrates pump 10 as a propulsion device. FIG. 10*a* illustrates the pump for moving an object along a surface. FIG. 10*b* illustrates the pump for moving an object suspended in a liquid. In FIG. 10 the actuators deform or bend when activated so the force exerted by the activated actuators has a directional component. In FIG. 10*a* the direction of propulsion will be in a linear direction depending on the direction of force. In FIG. 10*b* the direction of propulsion may be made to circular or circuitous by positioning the actuators at locations that unbalance total displacing force.

The pump and actuator housing of the present invention may be made by methods well known in the art. The actuator housing may be fabricated from materials such as polytetrafluoroethylenes, crystalline homopolymer acetal resins, polysulfones, polyurethanes, polyimides, polycarbonates, polymethylmethacrylates and similar polymers, moldable or machinable glasses, ceramics, silicon wafers and any other material that is, or can be, rendered nonconductive, rigid, and chemically inert. In certain embodiments, a porous member or frit is located between the actuators and an electrolyte solution. The frit may be glass, a porous polymer, such as for example polypropylene, or a porous non-corroding metal, such as, for example, nickel.

The actuator housing is preferably made by injection molding using a non conductive polymer. A chamber of the desired shape is formed inside the housing. First a flexible circuitry will be positioned in the mold cavity, the mold will be closed and positioned and injected with the molten polymer or similar material. The part will be removed from the mold and flashing removed. At this point, any secondary operations such as machining or drilling holes will be performed. Next, the actuators are installed in the chamber and a porous frit is placed between the polymer and a reservoir containing electrolyte solution. The next step will be to make and attach electrical connections and components not already molded into the housing. Following this, the elastomeric liner will be attached, if needed, and electrolyte added.

PREFERRED EMBODIMENT

In the preferred embodiment the actuators comprise an EAP material that swells from a pH change induced by irradiation of a light spectrum to the material. The swelling would be caused by a diffusion of electrolyte ions through the multilayered gel although this is a slow process it is compensated for by the addition of more active fluid channels in the housing. For example if one channel produced a flow rate of 1 ml per hr ten channels would produce 10 ml pr hr. A tuned photonics chip and optical fiber conduit would enable a single light source to deliver controlled irradiation to each actuator thereby reducing power consumption needs over the option of individual light sources for each actuator.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A pump for delivering a liquid to an outlet port, comprising:

a. an actuator housing having a chamber housing the liquid, the chamber having an inner surface and at least one outlet port for accommodating liquid flow through the chamber;

b. a plurality of individual actuators formed of a reversibly responsive elastomeric material selected from the group consisting of an electroactive polymer, an electrolytically activated polymer and an optically activated polymer, wherein the plurality of individual actuators are arranged in an array defining a plurality of flow paths within the chamber opposite to the inner surface and in contact with the liquid, wherein successive actuators in a flow path may be sequentially expanded from a starting position to advance the flow of liquid along a selected path through the chamber and out the outlet port; and c. a controller operative for sequentially controlling individual actuators to create at least one or a plurality of flow paths and also to control a rate of flow of liquid within individual flow paths whereby to displace the liquid at a chosen rate and flow path.

2. The pump of claim 1 wherein the actuator housing comprises two or more chambers for housing the liquid in fluid connection.

3. The pump of claim 1 wherein the controller is a programmable microprocessor in electrical connection with the activators.

4. The pump of claim 1 further comprising in addition a sensor for determining physical properties of the fluid, wherein the sensor is in electrical connection with the controller and is capable of delivering signals received from the liquid to the controller.

5. The pump of claim 4 wherein the physical properties sensed are selected from the group consisting of chemical composition, pH, pressure, temperature and flow rate.

6. The pump of claim 1 wherein the actuators are essentially inert and non-reactive with the liquid.

7. The pump of claim 1 wherein individual actuators are each encased in an material that is essentially inert and non-reactive with the liquid.

8. The pump of claim 7 wherein the pump further includes an electrolyte, and the material is semi-permeable to the electrolyte.

9. The pump of claim 7 wherein the pump further includes an electrolyte, and the material is non-permeable to the electrolyte.

10. The pump of claim 1 wherein each actuator is electrically or optically shielded from contiguous actuators.

11. The pump of claim 1 wherein the actuator housing comprises more than one inlet port each port being capable of receiving an individual fluid and wherein individual flow paths are determined for each fluid.

12. The pump of claim 1 comprising two or more outlet ports.

13. The pump of claim 1 wherein the flow paths of individual liquids intersect to allow mixing of fluids.

14. The pump of claim 1 wherein the actuator housing is located inside a chamber containing the fluid, the chamber being a component of an on-line fluid processing system and the inlet port and outlet ports of the actuator housing are on the axis of flow in the fluid processing system.

15. The pump of claim 1 comprising a connector for coupling the actuator housing into an on-line processing system.

16. The method of pumping a fluid at a controlled rate comprising placing the actuator housing of claim 1 into fluid contact with the fluid, activating a first actuator to prevent back-flow from the actuator housing and then repeatedly activating the contiguous actuators at a sequence wherein activation of one of the individual actuators occurs at a time after one of its contiguous actuators has been activated.

17. The method of claim 16 for pumping fluids of different viscosities wherein the pump comprises two or more actuator housings in fluid connection and each actuator housing is operated at a different flow rate.

* * * * *

UNITED STATES PATENT AND TRADEMARK OFFICE

CERTIFICATE OF CORRECTION

PATENT NO. : 9,039,389 B2
APPLICATION NO. : 14/071371
DATED : May 26, 2015
INVENTOR(S) : Mark Banister It is certified that error appears in the above-identified patent and that said Letters Patent is hereby corrected as shown below:

ON THE TITLE PAGE

Page 2, Col. 2, line 3, under FOREIGN PATENT DOCUMENTS, "6/1999" should be --6/1996--.

Page 2, Col. 2, line 13, under OTHER PUBLICATIONS, "121/721,800" should be --11/721,800--.

Signed and Sealed this
Twenty-second Day of December, 2015

Michelle K. Lee

Michelle K. Lee
*Director of the United States Patent and Trademark Office*